US010273420B2

(12) United States Patent
Banerjee et al.

(10) Patent No.: US 10,273,420 B2
(45) Date of Patent: Apr. 30, 2019

(54) PROCESS FOR HYDROTREATING A HYDROCARBONS STREAM

(71) Applicant: UOP LLC, Des Plaines, IL (US)

(72) Inventors: Soumendra Mohan Banerjee, New Delhi (IN); Peter Kokayeff, Naperville, IL (US); David A. Lindsay, Benicia, CA (US)

(73) Assignee: UOP LLC, Des Plaines, IL (US)

( * ) Notice: Subject to any disclaimer, the term of this patent is extended or adjusted under 35 U.S.C. 154(b) by 94 days.

(21) Appl. No.: 14/524,796

(22) Filed: Oct. 27, 2014

(65) Prior Publication Data

US 2016/0115399 A1 Apr. 28, 2016

(51) Int. Cl.

| | |
|---|---|
| ***C10G 65/04*** | (2006.01) |
| ***C10G 65/12*** | (2006.01) |
| ***C10G 65/08*** | (2006.01) |
| ***C10G 45/02*** | (2006.01) |

(52) U.S. Cl.

CPC ..... *C10G 65/04* (2013.01); *C10G 45/02* (2013.01); *C10G 65/08* (2013.01); *C10G 65/12* (2013.01); *C10G 2300/202* (2013.01); *C10G 2300/4056* (2013.01)

(58) Field of Classification Search

CPC ..... C10G 65/02; C10G 65/04; C10G 65/08; C10G 65/12

See application file for complete search history.

(56) References Cited

U.S. PATENT DOCUMENTS

| | | | | |
|---|---|---|---|---|
| 2,833,698 | A * | 5/1958 | Patton | C10G 65/16 208/210 |
| 3,445,378 | A * | 5/1969 | De Graff | C07C 7/005 203/39 |
| 3,494,854 | A * | 2/1970 | Gallagher | C10G 45/64 208/111.25 |
| 5,114,562 | A | 5/1992 | Haun et al. | |
| 5,705,052 | A * | 1/1998 | Gupta | C10G 49/002 208/210 |

(Continued)

FOREIGN PATENT DOCUMENTS

| | | | |
|---|---|---|---|
| AU | 2001251657 | A1 | 1/2002 |
| CN | 100478426 | C | 4/2009 |

(Continued)

OTHER PUBLICATIONS

Sakanishi et al. "Three-stage deep hydrodesulfurization of diesel fuel under 30kg/cu cm H2 pressure . . . ," Journal of the Japan Petroleum Institute (1993), 36(2), 145-148.

(Continued)

*Primary Examiner* — Michelle Stein

(74) *Attorney, Agent, or Firm* — Paschall & Maas Law Office, LLC; James C. Paschall

(57) ABSTRACT

Processes for hydrotreating a hydrocarbon stream in which a separation zone and a stripping zone is disposed between two hydrotreating reactors. The stripping zone may comprise a portion of the second hydrotreating reactor. The separation zone may comprise two separator vessels. A separator vessel may include the scrubbing zone to receive a scrubbing fluid, for example, steam, hydrogen, or heated effluent, and remove $H_2S$ and $NH_3$. A divided wall separator may be used. Vapor from the separator vessels can be recycled in the system.

20 Claims, 6 Drawing Sheets

(56) References Cited

U.S. PATENT DOCUMENTS

| | | | | |
|---|---|---|---|---|
| 6,083,378 | A * | 7/2000 | Gildert | B01D 3/009 208/209 |
| 6,103,104 | A * | 8/2000 | Gupta | C10G 65/00 208/210 |
| 6,416,658 | B1 * | 7/2002 | Maraschino | B01D 3/141 208/189 |
| 6,623,628 | B1 * | 9/2003 | Bronner | C10G 49/007 208/210 |
| 7,247,235 | B2 | 7/2007 | Virdi et al. | |
| 7,384,540 | B2 | 6/2008 | Galeazzi | |
| 7,435,335 | B1 | 10/2008 | Ellis et al. | |
| 2002/0117425 | A1 | 8/2002 | Knudsen et al. | |
| 2003/0070965 | A1 | 4/2003 | Shih et al. | |
| 2003/0111387 | A1 * | 6/2003 | Mukherjee | C10G 65/12 208/89 |
| 2012/0130143 | A1 * | 5/2012 | Van Doesburg | C10G 65/02 585/836 |
| 2013/0098802 | A1 | 4/2013 | Koseoglu et al. | |

FOREIGN PATENT DOCUMENTS

| | | | |
|---|---|---|---|
| EP | 1063275 | B1 | 8/2006 |
| WO | WO 2000/042125 | A1 | 7/2000 |

OTHER PUBLICATIONS

Song et al. "Study on the countercurrent deep hydrodesulfurization and hydrodearomatization of diesel fuel," Petroleum Processing and Petrochemicals (2006), 37(4), 1-6.

Shi et al. "Technical progress in hydrodesulfurization," Petroleum Refinery Engineering (1999), 29(8), 16-22.

Reinhoudt et al. "Catalysts for second-stage deep hydrodesulfurisation of gas oils," Fuel Processing Technology (1999), 61(1-2), 133-147.

* cited by examiner

PROCESS FOR HYDROTREATING A HYDROCARBONS STREAM

FIELD OF THE INVENTION

This invention relates generally to hydrotreating a hydrocarbon stream, and more particularly to hydrotreating a hydrocarbon stream in two different reactors, with at least a separation zone disposed between the two reactors.

BACKGROUND OF THE INVENTION

Processing and refining various hydrocarbons streams often involves hydrotreating the streams.

For example, petroleum refiners are keen to upgrade low value coker kerosene to high value feedstock like normal paraffins. Since coker kerosene contains high levels of sulfur and nitrogen, the coker kerosene has to be hydrotreated to reduce the levels of sulfur and nitrogen before the normal paraffins can be separated from the non-normal hydrocarbons in a separation zone, such as a Molex separation unit from UOP, LLC. (Des Plaines, Ill.).

Feed stream specifications for such separation zones require severe hydrotreating to reduce the sulfur to less than 1 wppm and nitrogen to 0.5 wppm (maximum). Additionally, one of the feed stream specifications is that the Bromine Index of the feed should be in the range of 50-100. Coker kerosene also contains olefins, diolefins, and aromatics. Typical aromatics content of coker kerosene is between 20 to 30 wt %. The olefin content is also quite high and is normally designated by the Bromine Number (which is roughly about 1000 times the Bromine Index), which is typically between 50 to 55. In order to meet all three feed specifications for sulfur, nitrogen and Bromine Index, hydrotreating at pressures of 3.4 to 7.6 MPag (500 to 1100 psig) is required.

As will be appreciated, these high pressures consume significant amounts of energy, and include high operating costs. It is always preferable to perform hydrotreating at the lowest possible pressure to reduce the capital cost of the hydrotreating unit so that a refiner will receive a better return on the investment in the hydrotreating unit. While it is possible to meet the sulfur and nitrogen specifications at a relatively lower pressure, for example, 4.8 to 6.2 MPag (700 to 900 psig), such lower pressures fail to achieve the desired Bromine Index for the product.

Normally a post-treatment reactor, loaded with a hydrotreating catalyst, is required to be installed downstream of the main hydrotreating reactor to achieve the desired Bromine Index specification. The post-treatment reactor has to operate at sufficiently high pressure and catalyst volume to meet the Bromine Index. Due to equilibrium limitations, the temperature of the post-treatment reactor should be in the range of 260 to 304° C. (500 to 580° F.) to ensure the required olefins saturation is obtained to meet the required Bromine Index requirements.

It would be desirable to have one or more processes that efficiently and effectively provide effluent streams that achieve the desired Bromine Index.

Additionally, refiners are constantly seeking to reduce the capital costs and operating expenses costs for various units, such as diesel hydrotreating units. Thus, it would also be desirable to have a process which provides quality product that meets all the specifications at low energy consumption is the requirement that refiners are keen to achieve. Finally, refiners are also seeking process for producing ultra-low sulfur diesel (ULSD) at a lower cost. In conventional process, a single stage operation is used with high catalyst volume to attain a product sulfur content of less than 10 wppm. Quite often when the reactor dimensions are restricted by site considerations (maximum weight or height) more than one reactor may be required in series to meet the product specifications.

Therefore, it would be desirable to provide one or more processes which can efficiently and effectively produce ultra-low sulfur diesel.

SUMMARY OF THE INVENTION

One or more processes have been developed in which a separation zone is utilized between two hydroprocessing reactors.

Accordingly, in a broad aspect of the present invention, the invention may be characterized as a process for hydrotreating a hydrocarbon stream by: hydrotreating a hydrocarbon stream in a hydrotreating zone comprising a hydrotreating catalyst and being operated under conditions sufficient to hydrotreat the hydrocarbon stream and provide a partially hydrotreated stream; separating the partially hydrotreated stream in a separation zone into a vapor stream and a liquid stream; stripping at least one of sulfur and nitrogen from at least a portion of the partially hydrotreated stream in a stripping zone; and, hydrotreating the liquid stream in a second hydrotreating zone comprising a hydrotreating catalyst and being operated under conditions sufficient to hydrotreat the hydrocarbon stream and provide a product hydrotreated stream. The stripping zone is disposed between the first hydrotreating zone and the second hydrotreating zone.

In some embodiments of the present invention, the hydrocarbon stream is a coker kerosene hydrocarbon stream. It is contemplated that the separation zone comprises a first separator vessel and a second separator vessel. The process may further include separating the partially hydrotreated stream in the first separator vessel of the separation zone into the vapor stream and the liquid stream. The second separator vessel may comprise a portion of the second hydrotreating zone. It is further contemplated that the second separator vessel includes a bed comprising the hydrotreating catalyst. It is also contemplated that the hydrotreating catalyst in the first hydrotreating zone and the hydrotreating catalyst in the second separator vessel comprises a noble metal catalyst on a support.

In one or more embodiments of the present invention, the process further includes stripping at least one of sulfur and nitrogen from the partially hydrotreated stream in the second separation vessel with a stripping gas. It is contemplated that the stripping gas comprises hydrogen.

In various embodiments of the present invention, the process also includes controlling a temperature of the partially hydrotreated stream at an inlet of the second separation vessel by passing the partially hydrotreated stream to a heat exchanger upstream of the inlet for the partially hydrotreated stream in the second separation vessel. It is contemplated that the heat exchanger comprises a stream generator and that the process also includes adjusting a pressure of the steam generator based upon a temperature of the partially hydrotreated stream at an outlet of the steam generator.

In one or more embodiments of the present invention, the hydrocarbon stream comprises a diesel stream. It is contemplated that the process also includes stripping at least one of sulfur and nitrogen from the partially hydrotreated stream in the stripping zone to provide a sweetened hydrotreated stream. The sweetened hydrocarbon stream may be hydrotreated in the second hydrotreating zone. It is further contemplated that the separation zone comprises a cold separator vessel and the stripping zone comprises a stripper vessel. The process may therefore also include stripping the at least one of sulfur and nitrogen from the partially hydrotreated stream in the stripping zone with steam.

In some embodiments of the present invention, the separation zone comprises a hot separator vessel and the stripping zone comprises a portion of the hot separator vessel. It is contemplated that the process also includes stripping the at least one of sulfur and nitrogen from the partially hydrotreated stream in the stripping zone with hydrogen. It is further contemplated that the second hydrotreating zone comprises a vessel and wherein the vessel of the second hydrotreating zone includes a second stripping zone. It is also contemplated that the process includes heating a portion of the sweetened hydrotreated stream to provide a heated sweetened hydrotreated stream and stripping the at least one of sulfur and nitrogen from the partially hydrotreated stream in the stripping zone with the heated sweetened hydrotreated stream. The second hydrotreating zone may include a vessel with a plurality of inlets for the partially hydrotreated stream.

In at least one embodiment of the present invention, the separation zone occupies a first portion of a vessel and the sweetening zone occupies a second portion of the vessel. The first portion is separated from the second portion by a wall. It is contemplated that the process includes heating the hydrocarbon stream with the partially hydrotreated stream and heating the partially hydrocarbon stream with the sweetened hydrotreated stream. It is further contemplated that the process also includes heating the liquid stream from the separation zone upstream up the second hydrotreating zone.

Additional aspects, embodiments, and details of the invention are set forth in the following detailed description of the invention.

DETAILED DESCRIPTION OF THE DRAWINGS

The drawings are simplified process diagrams in which.

DETAILED DESCRIPTION OF THE INVENTION

As mentioned above, one or more processes have been developed in which a separation zone is utilized between two hydroprocessing reactors.

In some embodiments of the present invention, the invention is used in association with a coker kerosene stream and a low pressure separator. In some embodiments the low pressure separator which may have some stripping trays. The hydrocarbons from the first reactor are stripped with the make-up hydrogen coming from the bottom of the separator. This stripping further reduces the level of hydrogen sulfide ($H_2S$) and ammonia ($NH_3$) in the hydrocarbons. Depending on the number of stripping stages used the $H_2S$ and $NH_3$ concentration can be reduced to ppb levels. The bottom of the low pressure separator may include noble metal catalyst to provide the second reactor or a reaction zone. The second reaction zone ensures that the Bromine Index of the product hydrocarbons are reduced to the level desired.

With these general principles of the present invention in mind, one or more embodiments of the present invention will be described with the understanding that the description is merely exemplary and not intended to be limiting.

Figure 1:
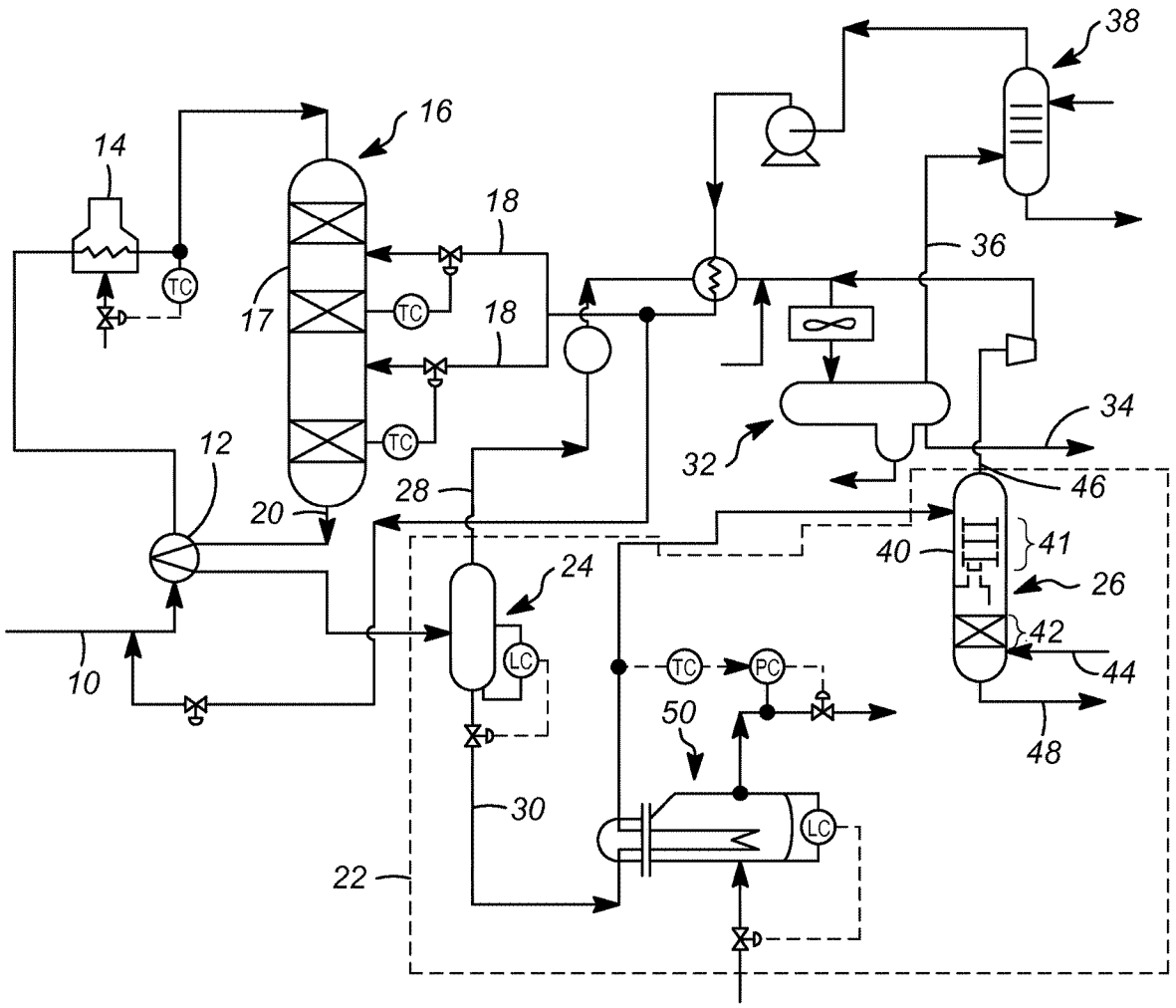
FIG. 1 shows a process according to an embodiment of the present invention.

As shown in FIG. 1, in a first embodiment of the present invention, a feed stream 10 is passed thought a first heat exchanger 12 to a charge heater 14. The feed stream 10 may comprise a coker kerosene stream. Unlike straight run kerosene, the hydrocarbons in coker kerosene are typically a mixture of both number and type (normal paraffinic, iso-paraffinic, aromatic, mono-olefinic, and diolefinic) of hydrocarbons and typically includes a Bromine Number between 50-55.

From the charge heater 14, the feed stream 10 is passed to a first hydrotreating zone 16 which includes a hydrotreating reactor 17. In the hydrotreating reactor 17, a hydrogen-containing treat gas 18 is used in the presence of one or more suitable catalysts which are primarily active for the removal of heteroatoms, such as sulfur and nitrogen, saturation of olefins and for some hydrogenation of aromatics present in the feed stream 10.

Suitable hydrotreating catalysts for use in the present invention are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts, as well as noble metal catalysts where the noble metal is selected from palladium and platinum. It is within the scope of the present invention that more than one type of hydrotreating catalyst be used in the same reaction vessel. The Group VI metal may be present in an amount ranging from about 2 to about 20 wt %, preferably from about 4 to about 12 wt %. The Group VI metal will typically be present in an amount ranging from about 1 to about 25 wt %, preferably from about 2 to about 25 wt %.

Typical hydrotreating temperatures range from about 204° C. to 440° C. (400° F. to 824° F.) with pressures from about 3.6 to 17.3 MPa (500 to 2500 psig), preferably from about 3.6 to 13.9 MPa (500 to 2000 psig).

An effluent stream 20 from the hydrotreating reactor 17 in the first hydrotreating zone 16 may be passed back through the heat exchanger 12 used with the feed stream 10 and then to a separation zone 22. In this embodiment of the present invention, the separation zone 22 comprises two vessels 24, 26.

A first vessel 24 comprises a hot separator which separates the effluent stream 20 from the hydrotreating reactor 17 in the first hydrotreating zone 16 into a vapor stream 28 and a liquid stream 30. As is known, the vapor stream 28, which comprises hydrogen, $NH_3$, $H_2S$, may be passed another separator 32 to provide a hydrocarbon stream 34 and a hydrogen rich stream 36. The hydrogen rich stream 36 may be passed through a scrubbing zone 38 (to remove $NH_3$ and $H_2S$), and then may be recycled to the first hydrotreating reactor 16 as the hydrogen stream 18. The hydrocarbon stream 34 from the separator 32 may be passed to a stripper (not shown) or combined with stream 30. The liquid stream from the first vessel 24 is passed to the second vessel 26 of the separation zone 22.

The second vessel 26 comprises a second hydrotreating reactor 40 which includes a separator portion 41 and a hydrotreating zone 42. The separator portion 41 includes one or more trays to facilitate separation of the components of the liquid steam 30. The hydrotreating zone 42 includes a hydrotreating catalyst, which may be the same as the catalyst in the first hydrotreating reactor 17, which preferably includes a noble metal containing catalyst. A noble metal catalyst, which is very effective in lowering the Bromine Index of the stream, however a noble metal catalyst performs best in a hydrogen sulfide ($H_2S$) and ammonia ($NH_3$) free environment. The majority of $H_2S$ and $NH_3$ in the effluent stream 20 from the first hydrotreating reactor 17 will be passed along in the vapor stream 28 from the first vessel 24. Accordingly, the liquid stream 30 from the first vessel 24 will have low concentration of $H_2S$ and $NH_3$ allowing for use of the noble metal catalyst.

A stripping gas 44 may be introduced into the second vessel 26, and preferably the stripping gas 44 comprises hydrogen. Accordingly, hydrogen in one section of the vessel 26 acts as a stripping gas, and in another section the hydrogen hydrotreats the hydrocarbons. Thus, the liquid stream 30 from the first vessel 24 is first stripped with the make-up hydrogen coming from the bottom of the second vessel 26. This stripping further reduces the level of $H_2S$ and $NH_3$ in the liquid. Depending on the number of stripping stages used the $H_2S$ and $NH_3$ concentration can be reduced to ppb levels. It is preferred that there are at least three stripping stages (or trays).

After being stripped, the hydrocarbons in the liquid stream 30 from the first vessel 24 are hydrotreated in the hydrotreating portion 42 of the second vessel 26 which includes the noble metal catalyst. This second stage hydrotreating ensures that the Bromide Index of the product is reduced to the desired level.

In addition to excess hydrogen, any vapor 46 in the second vessel 26 can be passed to the separator 32 discussed above for the vapor stream 28 from the first vessel 24. A desired product 48, preferably ULSD, from the second separator vessel 26 can be passed to a stripper (not shown) and processed further, as is known in the art.

In order to control a temperature of the liquid stream 30 from the first vessel 24 of the separation zone 22 at an inlet of the second vessel 26, the liquid stream 30 may be first passed through a heat exchanger 50. In a preferred embodiment, the heat exchanger 50 is a steam generator. In such a case, a pressure of the steam generator can be adjusted based upon a temperature of the liquid stream 30 from the first vessel 24 of the separation zone 22 at an outlet of the steam generator. Accordingly, the steam generation pressure can be adjusted to change the LMTD across the heat exchanger 50 and achieve the process temperature required at the exchanger outlet and for the inlet of the second vessel 26.

According to this embodiment of the present invention, the second reactor 26 is operated at a pressure of about 19-20 $Kg/cm^2g$. At such a pressure, the second reactor 26 can operate on a "once through" with hydrogen (as the stripping gas 44) entering without any further compression. The second hydrotreating reactor can operate at a lower temperature 66° C. to 93° C. (150° F. to 200° F.) since the feed is stripped free of $H_2S$ and $NH_3$ and would give the optimum performance.

Figure 2:
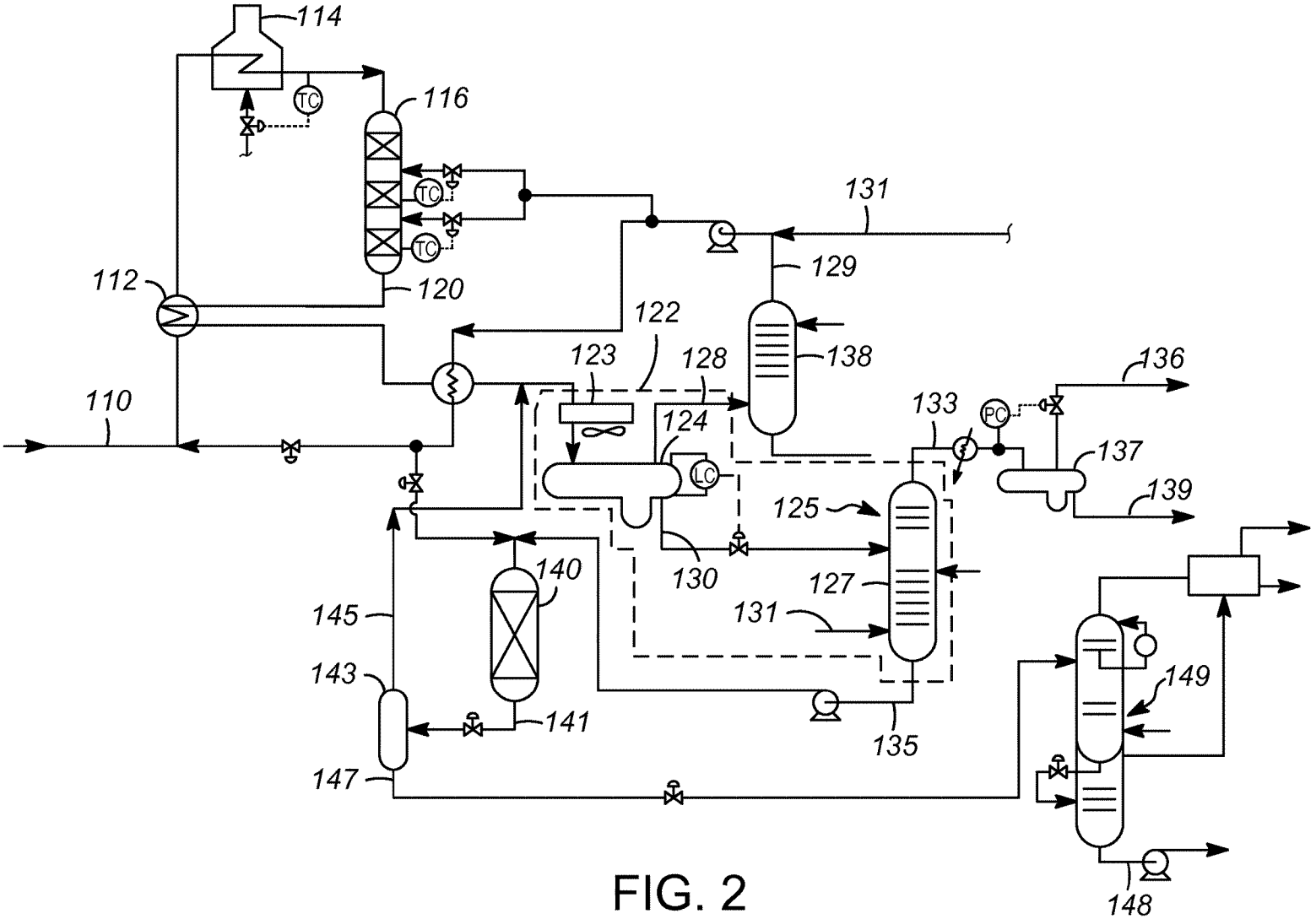
FIG. 2 shows another process according to an embodiment of the present invention.

Turning to FIG. 2, another embodiment of the present invention is shown in which a desired product 148 is an ultra-low sulfur diesel stream and a feed stream 110 is a hydrocarbon stream such as diesel stream laden with sulfur and nitrogen which is used for producing a diesel stream. As shown, according to this embodiment of the present invention, the feed stream 110 is heated in a heat exchanger 112 and a charge heater 114 and then passed to a first hydrotreating reactor 116. The operation of this reactor 116 is the same as the first hydrotreating reactor in the embodiment of FIG. 1. Once again, an effluent stream 120 from the first hydrotreating reactor 116 may be passed through the heat exchanger 112 to heat the feed stream 110 and then to a separation zone 122. As shown, the separation zone 122 includes a separator vessel 124 and a stripping zone 125. Preferably, the stripping zone 125 comprises a stripping vessel 127.

The separator vessel 124 of the separation zone 122 comprises a cold separator and is disposed downstream of a condenser 123, preferably an air-cooled condenser. In the cold separator 124, $H_2S$, $NH_3$, and hydrogen in the effluent stream 120 from the first hydrotreating reactor 116 can be separated off as a vapor stream 128. The vapor stream 128 can be passed from the cold separator 124 to a scrubbing zone 138, which separates $H_2S$ and $NH_3$ from the vapor stream 128. A scrubbed vapor stream 129, along with any make-up gas 131, can be passed back to the first hydrotreating reactor 116 as a recycle hydrogen gas.

A liquid stream 130 from the separator vessel 124 may be passed to the stripping vessel 127. In the stripping vessel 127, a stripping fluid 131, for example steam, may be introduced and used to strip additional $H_2S$ and $NH_3$ from the liquid stream 130. A sour gas stream 133 can be removed from the stripping vessel 127 and passed to a cold separator 137 to separate the lighter hydrocarbons into desired streams, for example a fuel gas stream in an overhead line 136 and a wild naphtha stream in the bottoms line 139. Additionally, a sweetened stream 135 from the stripping vessel 127 can be passed to a second hydrotreating reactor 140.

The second hydrotreating reactor 140 contains a catalyst, preferably a noble metal catalyst capable of hydrotreating the hydrocarbons in sweetened stream 135. It is contemplated that the second stage reactor 140 can also be loaded with isomerization catalyst to provide improvement in cold flow properties of the diesel produced by the process.

The effluent 141 from the second reactor 140 may be passed to a vessel 143 to separate into a gaseous stream 145 and a liquid stream 147. The gaseous stream 145 may be passed back to the cold separator 124 in the separation zone 122, while the liquid stream 147 can be passed to a vacuum drier 149. In the vacuum drier 149, water, as well as any residual $NH_3$ or $H_2S$ may be separated from a liquid products 147 to provide an ultra-low sulfur diesel stream 148.

An advantage of the process according to this embodiment is the reduction of the required operating pressure and operating costs compared to a conventional diesel hydrotreating unit. The first hydrotreating reactor 116 provides a bulk removal of sulfur and nitrogen compounds, which allows the second stage hydrotreating reactor to operate in a low $H_2S/NH_3$ environment which is favorable for deep desulfurization required for ULSD, and also for aromatics saturation which will provide significant cetane increase to the diesel. Another advantage of this embodiment, is the use of a vacuum drier to remove light ends and water from the effluent from the second hydrotreating reactor 140. This provides a utility savings compared to a conventional steam stripper.

Turing to FIGS. 3 to 6, various aspects of the present invention are shown utilizing a separation zone between two reactors to decouple bulk diesel desulfurization and denitrification reactions from conversion of more difficult sulfur and nitrogen compounds, aromatics saturation, ASTM D86 T95 control, and cold flow property improvement.

Figure 3:
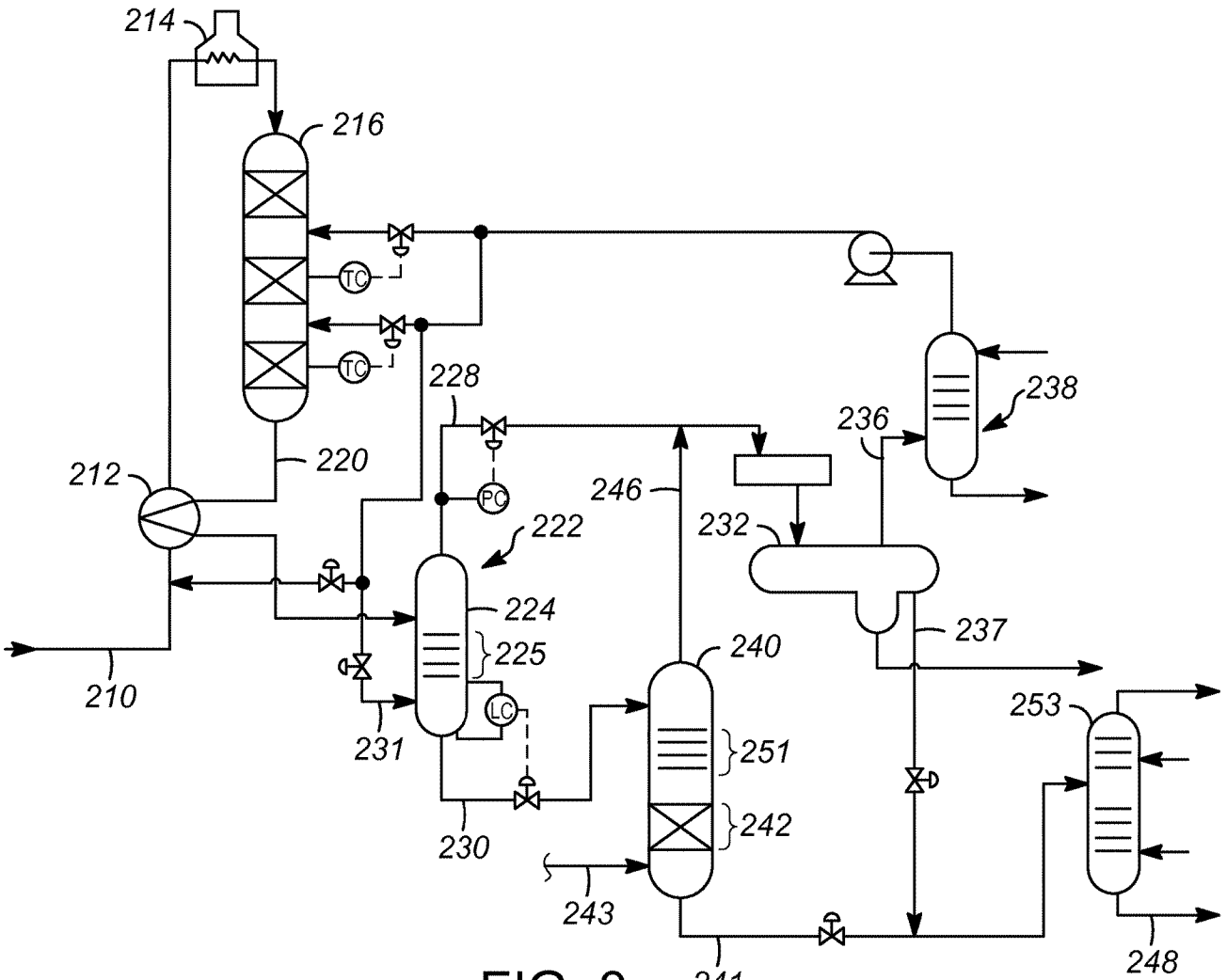
FIG. 3 shows yet another process according to an embodiment of the present invention.

In these processes, the feed may comprise a raw diesel stream. In FIG. 3, for example, a feed stream 210 is first heated in a heat exchanger 212 and a charge heater 214 and then passed to a first hydrotreating reactor 216. The operation of this first hydrotreating reactor 216 is the same as the first hydrotreating reactor 17 depicted in FIG. 1. An effluent stream 220 from the first hydrotreating reactor 216 is passed through the heat exchanger 212 to heat the feed stream 210 and then to a separation zone 222.

In this embodiment of the present invention, the separation zone 222 comprises a hot separator vessel 224 that includes a stripping zone 225. Recycle hydrogen can be used as a stripping fluid 231, and the pressure can be controlled. In the stripping zone 225, the stripping fluid 231 will remove $H_2S$ and $NH_3$ from the hydrocarbons in the effluent stream 220. Additionally, lighter hydrocarbons and hydrogen will also be separated from the hydrocarbons in the effluent stream 220.

A liquid stream 230 from the hot separator vessel 224 is passed to the second hydrotreating reactor 240. Preferably, the second hydrotreating reactor 240 also includes a stripping section 251 disposed above a hydrotreating section 242. The second hydrotreating reactor 240 receives a hydrogen containing gas 243. Similar to the embodiment of FIG. 1, the hydrogen containing gas 243 will be used as a hydrotreat gas in the hydrotreating section 242 and as a stripping gas in the stripping section 251. As should be appreciated, in the stripping section, $H_2S$ and $NH_3$ will be removed from the hydrocarbons. In the hydrotreating section 243, in the present of a catalyst, the Bromine Index of the hydrocarbons will be lowered.

In this embodiment, a vapor streams 228 from the hot separator vessel 224 and a vapor stream 246 and the second hydrotreating reactor 240 may be passed to a cold separator vessel 232 to separate a hydrogen rich recycle gas stream 236, a liquid hydrocarbon stream 237 and sour water. The hydrogen rich recycle gas stream 236 may be scrubbed in a scrubbing zone 238 and recycled to the first hydrotreating reactor 216, the hot separator vessel 224, a combination thereof, or to any other position in the process, for example to the second hydrotreating reactor 240 (not shown).

An effluent stream 241 from the second reactor 240 may be combined with the liquid hydrocarbon stream 237 from the cold separator vessel 232 and both may be passed to a stream stripper 253. A product diesel stream 248 may be recovered from the steam stripper 253.

Figure 4:
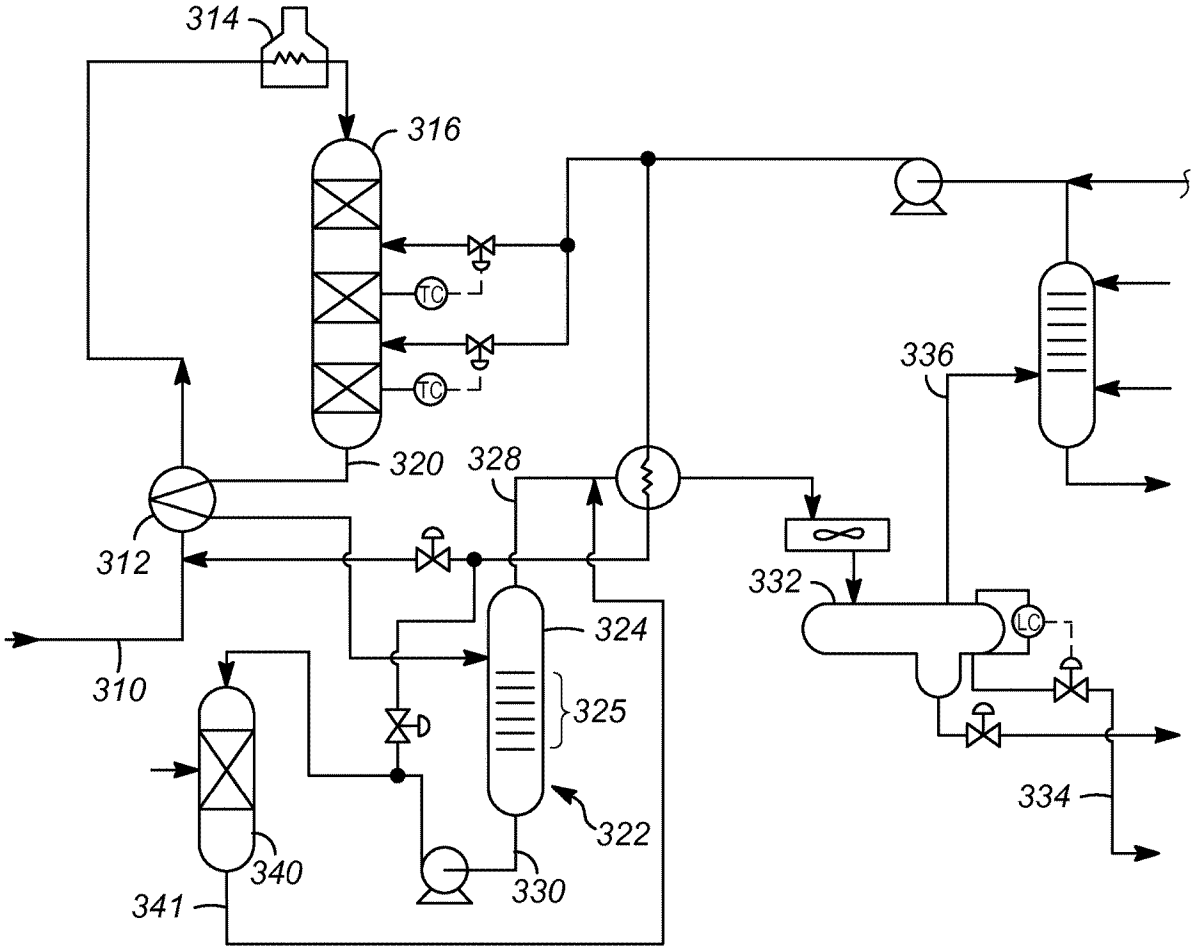
FIG. 4 shows still another process according to an embodiment of the present invention.

In FIG. 4, a feed stream 310, a heat exchanger 312, a charge heater 314, and first hydrotreating reactor 316 and an effluent stream 320 from the first hydrotreating reactor 316 are similar to the description above with respect to FIG. 3.

In this embodiment, a separation zone 322 comprises a separator vessel 324, and more particularly a hot separator vessel with a stripper section 325. Similar to the embodiment in FIG. 3, in the separator vessel 324, the effluent stream 320 from the first hydrotreating reactor 316 will separate into a liquid stream 330 and a vapor stream 328. The vapor stream 328 will include hydrogen, as well as $H_2S$ and $NH_3$ removed in the stripping section 325. The liquid stream 330 will be passed to the second hydrotreating reactor 340, which may include the same features or characteristics of previous described reactors discussed herein.

An effluent stream 341 from the second hydrotreating reactor 340 may be passed to a cold separator 332, along with the vapor stream 328 from the separator vessel 324, to separate a gas stream 336, a liquid hydrocarbon stream 334, and a sour water stream. The treatment of these streams is known and may be the same as discussed herein, with the liquid hydrocarbon stream 334 comprising the desired ULSD product which may be passed, to, for example, a stripper.

Figure 5:
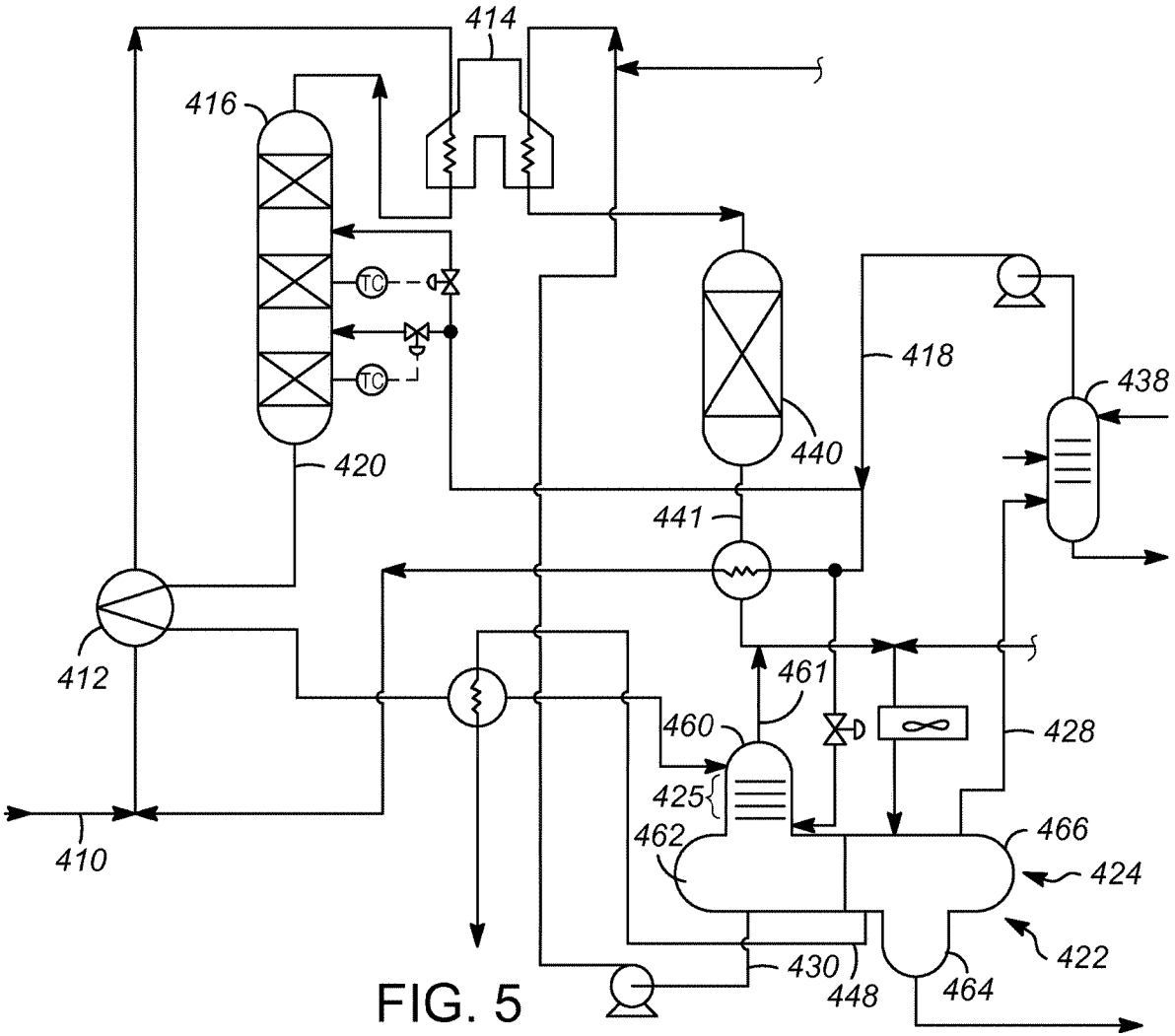
FIG. 5 shows a further process according to an embodiment of the present invention; and, FIG. 6 shows another process according to an embodiment of the present invention.

In the embodiment shown in FIG. 5, a feed stream 410 may be passed to a heat exchanger 412, additional charge heater 414, and then to a first hydrotreating reactor 416 (which may be operated according to any of the embodiments discussed herein). An effluent stream 420 from the first hydrotreating reactor 416 is passed to a separation zone 422.

In this embodiment of the invention, the separator 424 in the separation zone 422 comprises a divided wall separator with a tower 460 on a first side 462 and a boot 464 on a second side 466. The effluent stream 420 from the first hydrotreating reactor 416 enters the separator 424 via the tower 460 which includes a stripping section 425 which facilitates removal of $H_2S$ and $NH_3$ from the effluent stream 420 into a vapor stream 461. A liquid stream 430 from the first side 462 of the separator 424 may be heated in the charge heater 414 and then passed to a second hydrotreating reactor 440. The second hydrotreating reactor 440 may be operated as discussed herein in the other embodiments.

An effluent stream 441 from the second reactor 440 may be passed, along with the vapor stream 461 from the first side 462 of the divided wall separator 424, to the second side 466 of the divided wall separator 424.

In the second side 466, sour water may accumulate in the boot 464 of the divided wall separator 424. A vapor stream 428 from the second side 466 of the separator 424 may be passed to a scrubbing zone 438 which can provide recycle hydrogen 418 for the various stages of the process. A liquid hydrocarbon stream 448 may be passed from the divided wall separator 424 to stripper (not shown) as the desired ULSD product.

Figure 6:
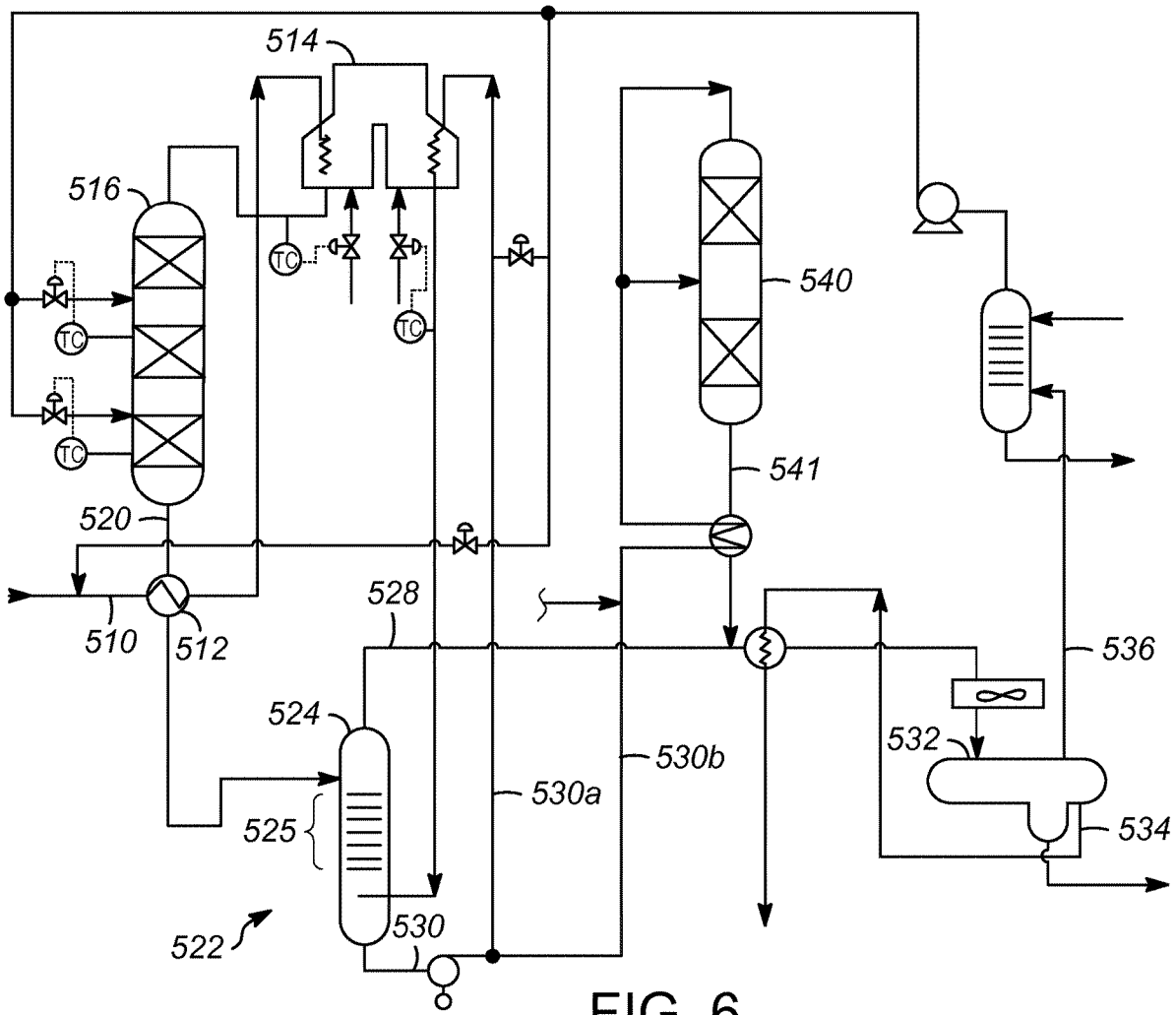

In FIG. 6, a feed stream 510 may be passed to a heat exchanger 512, an additional charge heater 514, and then to a first hydrotreating reactor 516 (which may be operated according to any of the embodiments discussed herein). An effluent stream 520 from the first hydrotreating reactor 516 is passed to a separation zone 522.

In this embodiment of their invention, the separation zone 522 includes a separator 524, preferably a hot separator with a stripping section 525. In this embodiment, a portion **530*a* of the liquid stream 530 from the separator 524 is heated in the charge heater 514 and returned to the separator 524 to act as stripping fluid to remove $H_2S$ and $NH_3$ from the effluent stream 520**.

A second portion **530*b* of the liquid stream 530 from the separator 524 is passed to a second hydrotreating reactor 540. The operation conditions of this reactor may be the same as those discussed herein. An effluent stream 541 from the second reactor 540, and a vapor stream 528 from the separator 524 in the separation zone 522, may be passed to a cold separator vessel 532**.

In the cold separator vessel 532, sour water may be removed from the cold separator vessel 532 via a boot. A gas stream 536 may be removed from the cold separator vessel 532, scrubbed, and recycled as hydrogen containing gas. A liquid hydrocarbon stream 534 comprising a diesel stream may be passed from the cold separator vessel 532 to, for example, a stripper (not shown).

In these various processes, the entire feed may be combined with recycle gas upstream of a conventional desulfurization reactor.

It is believed that a process could remove approximately 90-95% of the sulfur compounds in the feed stream. This would remove mostly the "easy" sulfur compounds to remove, as well as a portion of the more difficult sulfur compounds. The reactor effluent from the first reactor would then be sent to a separator, to remove $NH_3$ and $H_2S$, and the liquid would be passed to a second reactor.

The second reactor may contain catalyst designed to operate in a low $H_2S$ and $NH_3$ environment to convert sterically hindered dibenzothiophene molecules, convert by hydrocracking the highest boiling compounds, and isomerize the normal paraffin compounds in the feed in order to meet the overall ULSD (EuroV) specifications. The product from the second reactor may then be directed to a diesel product stripper.

The potential advantages of one or more of these processes are a lower operating pressure due to reduced severity in the first reactor compared to a conventional diesel hydrotreater. The second reactor operates with very low $H_2S$ and $NH_3$ levels and high hydrogen purity to enhance reaction rates, even at relatively low hydrogen partial pressure.

Additionally, at least one of these processes provides for a reduced recycle gas rate a benefit of lower severity in the first reactor. Additionally, the tailored use of hydrogen minimizes total hydrogen consumption to meet a specific product target Furthermore, at least one of the processes provides for a first reactor operating at relatively high temperature at end of run conditions which will extend the life of this catalyst. There should no apprehension about aromatics equilibrium in the first reactor since aromatics may be controlled in the second reactor with a noble metal catalyst.

These products also allow for customization of products by the catalyst in the second reactor which can be tailored to meet the controlling objectives: noble or base metal treating catalyst for sulfur and aromatics removal; noble metal isomerization/cracking catalyst for cold flow property improvement; noble or base metal hydrocracking catalyst for T95 point reduction.

Finally, the reduction in operating pressure and gas rate of the first reactor, when compared to a conventional hydrotreater, is expected to significantly reduce both unit capital and operating costs.

Therefore, in the various processes, the separation zone between the two reactors has provided effective and efficient processing of a hydrocarbon stream.

It should be appreciated and understood by those of ordinary skill in the art that various other components such as valves, pumps, filters, coolers, etc. were not shown in the drawings as it is believed that the specifics of same are well within the knowledge of those of ordinary skill in the art and a description of same is not necessary for practicing or understating the embodiments of the present invention.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A process for hydrotreating a hydrocarbon stream, the process comprising:

hydrotreating a hydrocarbon stream in a hydrotreating zone comprising a hydrotreating catalyst and being operated under conditions sufficient to hydrotreat the hydrocarbon stream and provide a partially hydrotreated stream;

separating the partially hydrotreated stream in a separation zone comprising a first separator vessel into a vapor stream and a liquid stream;

stripping at least one of sulfur and nitrogen from at least a portion of the liquid stream in a stripping zone;

passing the vapor stream to a second separator vessel to provide a gas stream comprising hydrogen gas;

hydrotreating the liquid stream from the stripping zone in a second hydrotreating zone operating at a temperature of about 66° C. to 93° C. comprising a hydrotreating catalyst and being operated under conditions sufficient to hydrotreat the hydrocarbon stream and provide a product hydrotreated stream, wherein the stripping zone is disposed between the first hydrotreating zone and the second hydrotreating zone and a hydrogen stream introduced to the second hydrotreating zone to hydrotreat the liquid stream in the second hydrotreating zone, passes from the second hydrotreating zone to the stripping zone prior to being scrubbed to remove hydrogen sulfide, and the hydrogen stream passed to the stripping zone is used to strip the at least the portion of the liquid stream in the stripping zone.

2. The process of claim 1 wherein the hydrocarbon stream is a coker kerosene hydrocarbon stream.

3. The process of claim 1 wherein the separation zone comprises a first separator vessel and a second separator vessel, and the process further comprising:

separating the partially hydrotreated stream in the first separator vessel of the separation zone into the vapor stream and the liquid stream; and stripping at least one of sulfur and nitrogen from the liquid stream in the second separator vessel , wherein the second separator vessel comprises a portion of the second hydrotreating zone.

4. The process of claim 3 wherein the second separator vessel includes a bed comprising the hydrotreating catalyst in the second separator zone, and wherein the hydrotreating catalyst in the first hydrotreating zone and the hydrotreating catalyst in the second separator vessel comprises a noble metal catalyst.

5. The process of claim 3, wherein stripping at least one of sulfur and nitrogen in the second separation vessel is performed with a stripping gas in the stripping zone, wherein the stripping zone is disposed within the second separation vessel.

6. The process of claim 3 wherein the stripper is above the second hydrotreating zone in the second separator vessel.

7. The process of claim 3 further comprising:

controlling a temperature of the partially hydrotreated stream at an inlet of the second separation vessel by passing the partially hydrotreated stream to a heat exchanger upstream of the inlet for the partially hydrotreated stream in the second separation vessel.

8. The process of claim 7 wherein the heat exchanger comprises a stream generator, and further comprising:

adjusting a pressure of the steam generator based upon a temperature of the partially hydrotreated stream at an outlet of the steam generator.

9. The process of claim 1 wherein the hydrocarbon stream comprises a diesel stream.

10. The process of claim 9 further comprising:

stripping at least one of sulfur and nitrogen from the partially hydrotreated stream in the stripping zone to provide a sweetened hydrotreated stream, wherein at least a portion of the sweetened hydrocarbon stream is hydrotreated in the second hydrotreating zone.

11. The process of claim 10 wherein the separation zone comprises a cold separator vessel and the stripping zone comprises a stripper vessel.

12. The process of claim 11 further comprising:

stripping the at least one of sulfur and nitrogen from the partially hydrotreated stream in the stripping zone with steam.

13. The process of claim 10 wherein the separation zone comprises a hot separator vessel and the stripping zone is disposed within the hot separator vessel.

14. The process of claim 13 further comprising:

stripping the at least one of sulfur and nitrogen from the partially hydrotreated stream in the stripping zone with hydrogen.

15. The process of claim 14 wherein the second hydrotreating zone comprises a vessel and wherein the vessel of the second hydrotreating zone includes a second stripping zone.

16. The process of claim 13 further comprising:

heating a remaining portion of the sweetened hydrotreated stream to provide a heated sweetened hydrotreated vapor stream; and, stripping the at least one of sulfur and nitrogen from the partially hydrotreated stream in the stripping zone with the heated sweetened hydrotreated vapor stream.

17. The process of claim 10 wherein the separation zone occupies a first portion of a vessel and the sweetening zone occupies a second portion of the vessel, the first portion being separated from the second portion by a wall.

18. The process of claim 17 further comprising:

heating the hydrocarbon stream with the partially hydrotreated stream; and heating the partially hydrocarbon stream with the sweetened hydrotreated stream.

19. The process of claim 18 further comprising:

heating the liquid stream from the separation zone upstream up the second hydrotreating zone.

20. A process for hydrotreating a hydrocarbon stream, the process comprising:

hydrotreating a hydrocarbon stream in a hydrotreating zone comprising a hydrotreating catalyst and being operated under conditions sufficient to hydrotreat the hydrocarbon stream and provide a partially hydrotreated stream;

separating the partially hydrotreated stream in a separation zone comprising a first separator vessel into a liquid stream and a vapor stream comprising hydrogen gas;

stripping at least one of sulfur and nitrogen from at least a portion of the liquid stream in a stripping zone;

passing at least a portion of the vapor stream comprising hydrogen gas to a second hydrotreating zone;

hydrotreating the liquid stream from the stripping zone in the second hydrotreating zone operating at a temperature of about 66° C. to 93° C. comprising a hydrotreating catalyst and being operated under conditions sufficient to hydrotreat the hydrocarbon stream and provide a product hydrotreated stream, wherein the stripping zone is disposed between the first hydrotreating zone and the second hydrotreating zone and a hydrogen stream introduced to the second hydrotreating zone to hydrotreat the liquid stream in the second hydrotreating zone, passes from the second hydrotreating zone to the stripping zone prior to being scrubbed to remove hydrogen sulfide, and the hydrogen stream passed to the stripping zone is used to strip the at least the portion of the liquid stream in the stripping zone.

* * * * *